United States Patent [19]

Riesen

[11] Patent Number: 4,872,487

[45] Date of Patent: Oct. 10, 1989

[54] PROJECTILE-CATCHING BRAKE FOR A LOOM

[75] Inventor: Peter Riesen, Elgg, Switzerland

[73] Assignee: Sulzer Brother Limited, Winterthur, Switzerland

[21] Appl. No.: 157,382

[22] Filed: Feb. 18, 1988

[30] Foreign Application Priority Data

Mar. 5, 1987 [CH] Switzerland ..... 00826/87

[51] Int. Cl.[4] ..... D03D 49/54

[52] U.S. Cl. ..... 139/185; 188/264 D

[58] Field of Search ..... 139/185, 186, 187, 196.2, 139/438, 439; 188/264 D, 264 P, 264 R, 259

[56] References Cited

U.S. PATENT DOCUMENTS

| | | | |
|---|---|---|---|
| 3,395,737 | 8/1968 | Wueger | 139/185 |
| 3,865,150 | 2/1975 | Demuth | 139/185 |
| 4,077,499 | 3/1978 | Baram | 188/264 D |
| 4,295,498 | 10/1981 | Davis | 139/196.2 |
| 4,470,484 | 9/1984 | Norgren | 188/264 D |
| 4,508,200 | 4/1985 | Cigognini | 188/264 D |

*Primary Examiner*—Henry S. Jaudon

*Attorney, Agent, or Firm*—Kenyon & Kenyon

[57] ABSTRACT

To improve performance and to overcome dangerous problems of overheating in projectile looms, the loom brake has a cooler for dissipating the heat of braking and for reducing local temperature peaks. A coolant is guided in a flow into the vicinity of the braking surfaces. Appropriate cooling facilities can have air nozzles aimed at the braking surface, a liquid circuit supplying coolant to ducts within the brake shoes or tubes in heat-conductive contact with the brake shoes or heat pipes.

15 Claims, 3 Drawing Sheets

PROJECTILE-CATCHING BRAKE FOR A LOOM

This invention relates to a projectile-catching brake for a loom. More particularly, this invention relates to a projectile-catching brake for a loom having a pair of brake shoes.

As is known, the main requirements of a projectile-catching brake for a loom are that the brakes must be capable of reliable retardation of the projectiles so that the projectiles stop at a predetermined place without knocks on the projectiles causing mispicks, reduced wear and low service costs. In particular, heating of the brakes by braking energy must remain within safe limits.

Various devices have been known which enable these requirements to be met up to a particular level of performance so far as conventional steel projectiles are concerned. For example, Russian Patent No. 937,560 describes a catching brake having a metal plate as support and a non-reinforced polymer layer on the metal plate to increase working life and improve heat dissipation. Since this layer of thermally insulating material, for example, fluoroplastics, is quite thick, dissipation of the heat of braking remains unsatisfactory and, in particular, inadequate for looms having plastics projectiles Swiss Patent 655,140 discloses a method of reducing the heat of friction evolved in a brake wherein the braking effect of a two-part brake is partly cancelled in the projectile return by disengaging the second braking part. However, the total braking energy is reduced only by some 10 to 20% by this reduction of the braking heat evolved in the return movement. This feature is far from enabling the brake to be used in looms having plastic projectiles. Also, the highest temperatures in the brake occur in the front part and not in the rear second part. The known method, therefore, provides no improvements with respect to the dangerous maximum temperatures in the front part of the brake.

Unfortunately, all these known devices are of use only for steel projectiles and have reached the final limit of their performance, since, as projectile speed increases, the kinetic energy to be retarded rises with the square of the speed. Thus, heating of the braking-surface pair of the projectile and the brake increases correspondingly in an intense manner, leading to softening and destruction of the plastics and elastomers used and to sharply rising and unacceptable wear. Changes also occur in braking pressures and the coefficients of friction of the brake linings, with the result of unwanted variations in the braking force making stoppage of the projectile in the required narrow zone impossible. The projectiles either overshoot or undershoot, with the result of failure of braking, defects and consequential damage.

Picking speed and loom output can be increased considerably by using new plastics projectiles in place of conventional steel projectiles. However, the known brakes which have plastics and elastomeric brake shoes cannot be used in looms for plastics projectiles. A known more developed catching brake having an additional metal brake plate on the elastomeric brake shoes cannot overcome these fundamental shortcomings of performance and speed. The problem of meeting the far higher demands of a catching brake cooperating with plastic projectiles has so far not even been correctly recognized, for a further considerable problem arises with plastics projectiles in that most of the heat of braking-up to 90% and more -must be absorbed by the brake. Conversely, with steel projectiles, by far the largest proportion of the heat of braking is taken up by the projectile and can be yielded to the environment during the relatively long return movement. Conventional brakes for steel projectiles, with their very reduced ability to dissipate heat, are therefore basically unsuitable for plastics projectiles.

Another problem arising at high picking rates and correspondingly high braking powers is that not only is there a correspondingly intense average heating of the brake and projectiles but also some parts of the brake and the projectiles may experience very dangerous local temperature peaks which are considerably above the average brake surface temperature and which inevitably lead to the destruction of the plastics surface as a result of softening, chemical decomposition and plastic deformation. This, in turn, leads to unacceptably high wear, frequent defects, malfunctioning and consequential damage to the looms, with correspondingly high servicing and repair costs.

Accordingly, it is an object of the invention to obviate the heating problems of a projectile-catching brake in a loom.

It is another object of the invention to ensure constant braking properties for a projectile-catching brake of a loom.

It is another object of the invention to provide a projectile catching brake which is capable of high picking rates and picking powers.

It is another object of the invention to provide a projectile-catching brake for the modern lighter plastic projectiles which are in use.

It is another object of the invention to improve the working life of the replacement elements used in a projectile-catching brake while improving servicing and maintenance.

Briefly, the invention provides a projectile catching brake having a pair of brake shoes defining braking surfaces for catching a projectile therebetween with cooling means for directing a flow of coolant at least into the vicinity of the braking surfaces in order to dissipate the heat evolved in braking and for reducing local temperature peaks.

The coolant may be guided by any suitable conveying and/or guide means in a flow to the vicinity of the braking surfaces. The heat evolved in braking is thus received by the coolant immediately at the place where evolved and is immediately dissipated. Thus, dangerous temperature peaks are prevented from building up.

Advantageous embodiments can have ducts extending through the brake shoes or coolant-guiding pipes which are in heat-conducting contact with the brake shoes. A liquid coolant can be used with a closed cooling circuit and a heat exchanger to remove the absorbed heat of braking. However, air can be guided as coolant in a flow directed towards the braking surface, particularly, directed onto the front part of the brake which experiences maximum heating. Advantageously, in this case, the air can be supplied at elevated pressure and issed through nozzles disposed near the braking surface.

Heat pipes with their very high ability to dissipate heat can be used as the cooling means, one end of the pipe extending along the braking surfaces as a cooler while the other end has a heat exchanger.

An open evaporation cooler having capillary evaporation surfaces on the braking surfaces may be advantageous, for example, using water which because of the substantial heat of evaporation evolved provides a very effective and directed cooling action.

An advantageous construction can have brake shoes made mainly of metal, at least one brake shoe being embodied in a resilient form with voids, the pairs of braking surfaces being made of metal and abrasion-resistant plastics. In the case of projectiles having plastic surfaces, the metal surface of the braking pair is embodied by the brake shoes.

The resilient form of the brake shoe can be embodied by a hollow section member which can be stressed in bending. This leads to a very advantageous ratio of large brake area to low unsprung weight, thus reducing impacting of the projectile. Because of the large area and the rapid heat distribution of the heat-conductive metal embodiment, the heat of braking can be removed rapidly, for example, by a flow of cooling air directed at a surface. Because the braking surfaces are made of metal, braking properties remain constant even at very high braking efforts since there is no possibility of softening and chemical breakdown of the braking surfaces. Preferably, a large braking contact surface is provided in order to reduce braking pressures and specific wear and to distribute the heat of braking over a large area with the result of correspondingly low temperatures. Since the catching brake heats up most in the front part near the projectile entry, an effective cooling device is best operative in this maximum heating zone, for example, by an appropriate arrangement and orientation of cooling air nozzles. Conveniently, the cooling output on both sides of the brake is adapted to the corresponding braking efforts. As a rule, the braking effort of each of the bottom top brake shoes is substantially the same since pressures and coefficients of friction are substantially the same at the top and at the bottom.

These and other objects and advantages of the invention will become more apparently from the following detailed description taken in conjunction with the accompanying drawings wherein.

Figure 4:
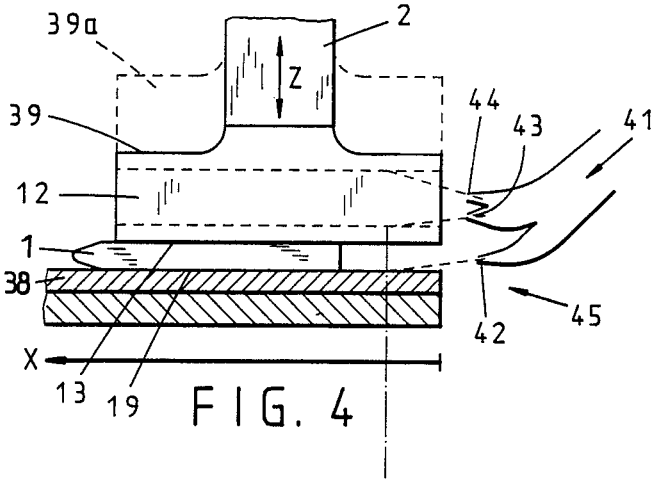
FIG. 4 illustrates a modified brake having an air cooling means in accordance with the invention.
Figure 4A:
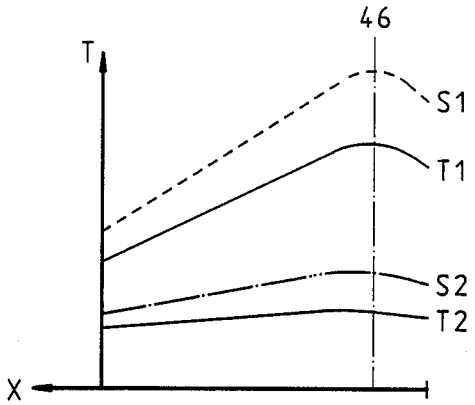
Figure 5:
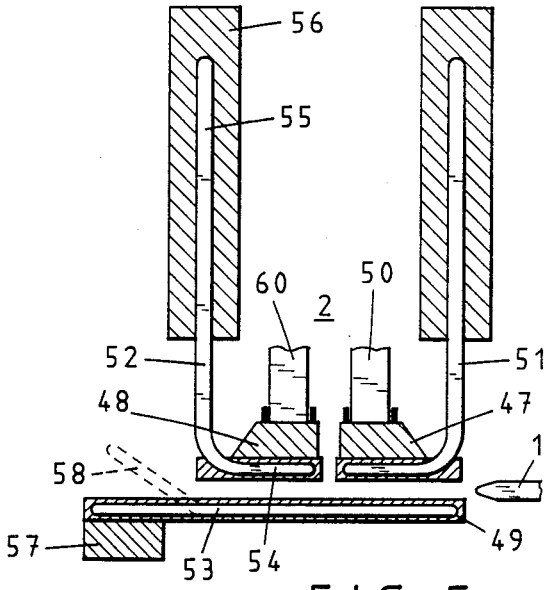
Figure 6:
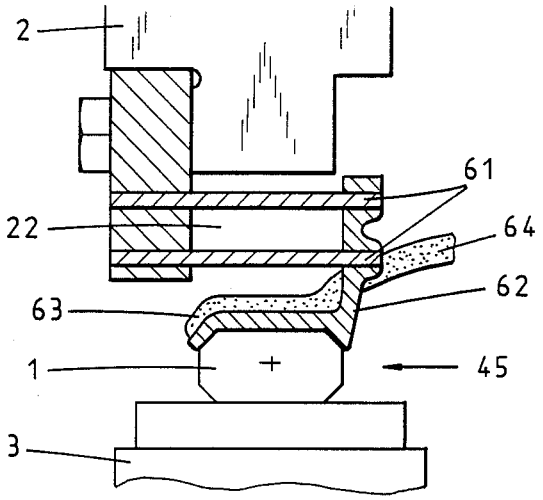
Figure 7:
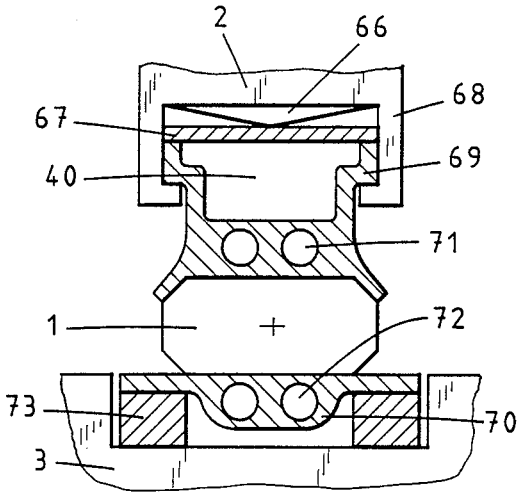
Figure 8:
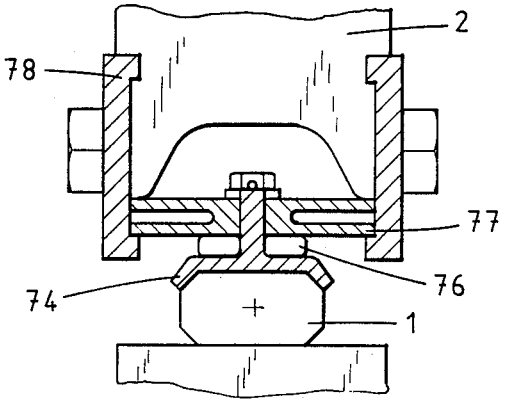

FIG. 4*a* graphically illustrates the temperature distributions in a brake illustrated in FIG. 4;

FIG. 5 illustrates a cross-sectional view of a brake employing heat pipes in accordance with the invention;

FIG. 6 illustrates a modified brake employing an evaporation cooler in accordance with the invention;

FIG. 7 illustrates a modified brake shoe employing ducts in accordance with the invention; and FIG. 8 illustrates a further modified brake shoe employing fiber reinforced plastic springs in accordance with the invention.

Figure 1:
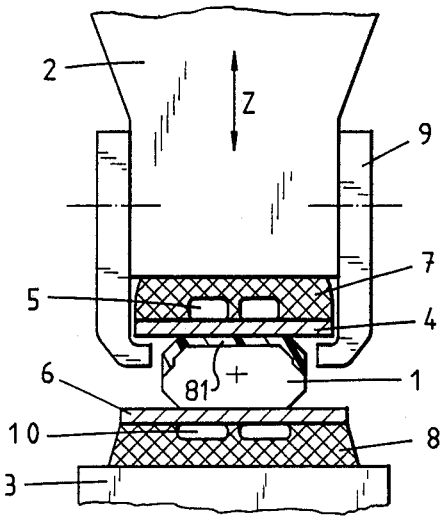
FIG. 1 illustrates a part cross-sectional view of a projectile-catching brake constructed in accordance with the invention.

Referring to FIG. 1, the projectile-catching brake for catching a projectile 1 having plastic outer surfaces 81 as schematically illustrated includes a pair of brake shoes 4, 6 of metal for engaging a plastic projectile 1. Each shoe 4, 6 is mounted by way of a rubber pad 7, 8, for instance, of resilient polyurethane in a respective mounting 2, 3. In addition, the top brake shoe 4 is guided by lateral guide plates 9 secured to the top brake mounting 2 so as to be vertically reciprocable as indicated by the double arrow Z.

The heat of friction arising during braking heats the brake shoes 4, 6 considerably. However, the pads 7, 8 which are required for springing and damping and which are several milli-meters thick make it virtually impossible for the heat of braking to be removed to the mountings 2, 3. Substantially no heat can be removed by way of the side plates 9 since the moving shoe 4 must always have some clearance from the fixed plates 9. Should high picking speeds occur, the shoes 4, 6 and the plastic surfaces 81 of the projectile 1 would become hotter and hotter leading, initially, to rapidly increasing wear and, finally, to melting and breakdown of the plastic surface and, therefore, to a malfunctioning of the loom.

In order to obviate the problems of overheating, a cooling means is provided for directing a continuous flow of coolant at least into the vicinity of the braking surfaces of the shoes 4, 6. As illustrated, the cooling means is in the form of metal cooling pipes 5, 10 through which a coolant flows and which provide a satisfactory heat-conducting contact with the brake shoes 4, 6, for example, by soldering or brazing. As indicated, the pipes 5, 10 are very near the braking surfaces between the projectile 1 and the brake shoes 4, 6. Because of the resulting high dissipation of heat by the coolant, the thickness of the shoes 4, 6 and, therefore, their unsprung weights can be much less than in known constructions without cooling.

Figure 2:
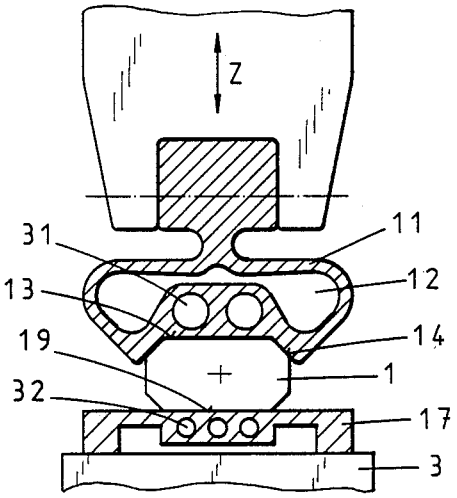
FIG. 2 illustrates a modified projectile-catching brake employing a hollow section member and cooling ducts in accordance with the invention.

Referring to FIG. 2, wherein like reference characters indicate like parts as above, the top brake shoe 11 may be made entirely of metal and may be in the form of a hollow section member having an interior 12 to provide self-springing properties. This member is basically a flat-pressed L-shaped steel spring which is stressed in bending. The interior 12 is open at the front and at the rear in the picking direction, i.e. in the direction of viewing, so that a directed flow of air can be operative for cooling through the interior 12.

The shape of the metal brake shoe 11 leads to a large brake contact surface 13 and to a large area to reduce the specific load and the wear of the braking surfaces and to ensure high heat dissipation and substantial heat exchange with the environment or with a coolant. The bottom metal brake shoe 17 is a self-resilient spring plate. The cooling means, in this case, is in the form of ducts 31, 32 with which the brake shoes 11, 17 are formed very near the braking surfaces and through which a liquid coolant, such as softened water flows. However, instead of the ducts 31, the entire interior 12 of the brake shoe can be used for the coolant to flow through.

Figure 3:
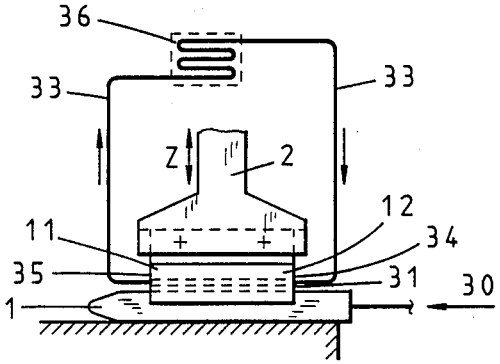
FIG. 3 illustrates a view of a cooling circuit employed with the brake of FIG. 2.

Referring to FIG. 3, to provide for a flow-through of coolant, the front 34 and back 35 of the brake shoe 11 are closed by means of a resilient cover having a flow and return line 33. The coolant flowing through the interior 12 can be circulated by an external pump or by the movement of the brake shoe 11 as the shoe 11 is stroked in each braking operation, this brake shoe movement being operative in association with a check valve as a circulator. The cooling liquid which has heated up on the brake shoes flows through flexible supply lines 33 (FIG. 3) into a heat exchanger 36, then back into the brake shoe cooling ducts 31. The plastics projectile 1 enters the brake in the picking direction 30.

In contrast to the known uncooled catching brakes, the cooled brakes are distinguished more particularly by substantially constant braking properties, i.e. their coefficient of friction, spring rates and spring forces remain substantially constant over a long period of time. Only if braking properties are constant can the projectile be reliably stopped in a predetermined zone. The conventional uncooled elastomeric brakes are subject, for example, to substantial differences between their cooled state when the loom starts and their hot state in operation, so that continuous adjustment and re-adjustment are necessary.

Referring to FIG. 4, the brake may also be air-cooled. In this example, both the top brake shoe 39 and the bottom brake shoe 38 are unitary metal brake shoes. The top brake shoe 39, which is, for example, of a resilient kind having a hollow interior 12 as in FIG. 2, is movable as indicated by a double arrow Z. During braking, the brake shoe 39 engages the projectile 1. When the projectile 1 is ejected into the return conveyor (not shown) the brake shoe disengages, as indicated by its chain line position 39*a*. The cooling means includes a supply duct for an inflow 41 of air and air nozzles 42–44 for guiding the infed air 41 in directed streams onto the braking contact surfaces 13, 19 and onto the walls of the interior 12. Preferably, the nozzles 42–44 are so aimed that the infed pressurized air 41 is incident in the maximum-temperature temperature zone 46, the cooling air being cooled by adiabatic expansion. Advantageously, the nozzles 42–44 are so arranged that even when the brake shoe 39 moves into its position 39*a*, the jet of at least one nozzle remains directed at the maximum-temperature zone. The nozzle directions can of course follow the brake shoe movement synchronously.

FIG. 4*a* is a diagram showing temperatures plotted against the distance X on the contact surfaces 13, 19, S1 and T1 denoting the uncooled state while S2 and T2 denote the cooled state. The curves T1, T2 represent the average temperatures while S1, S2 represent the brief temperature peaks arising during deceleration. The two uncooled curves S1, T1 rise abruptly to high peaks at the place 46, which is in the front part of the brake near the place of entry of the projectile 1. If the brake is to operate satisfactorily these dangerous temperatures of S1 and T1 must be greatly reduced, the curves having to be flatter ad the temperatures having to be much lower. This is achieved by the cooling effected by the air flow from the nozzles 42–44, the main feature being that the average temperatures T2 are lowered and the peak temperature pattern S2 becomes flatter.

Referring to FIG. 5, a braking system may be provided with a pair of brakes disposed in series, for example with one brake having a brake shoe 47 secured to a front mounting 50 and the second brake having a brake shoe 48 secured to a rear mounting 60. In this embodiment, the cooling means is in the form of a respective heat pipe 51, 52 in each brake shoe 47, 48. The braking heat of the brake shoe is removed in evaporation section 54 of the heat pipes and passes to a condensation section 55 where a heat exchanger 56, for example, in the form of a lightweight ribbed aluminum section member, yields the heat of braking to the ambient air. Similarly, a bottom unitary brake shoe 49 comprises at least one heat pipe 53 and an associated heat exchanger 57. To enhance the return of coolant by capillary action in the heat pipe 53, the pipe 53 can have a bent-up part 58 laterally adjacent the picking channel.

Referring to FIG. 6, the brake shoe may be constructed of a stationary metal body 62 mounted on a pair of transverse spring strips 61 so as to be self-sprung. The strips 61 define a gap 22 and also function to guide the brake body 62. The spring strips 61 are made of fiber-reinforced plastics, carbon and glass fibers being particularly suitable. The cooling means is in the form of an open evaporation cooler comprising a capillary evaporation surface 63 on the brake shoe body 62, the heat of braking being removed from the brake shoe body 62 by a consumable liquid, such as softened water with any necessary additives. The coolant is infed through a capillary tube 64 which is movable with the body 62. Infeeding can be controlled and metered in accordance with the operating conditions of the loom.

Another way of providing effective cooling using a consumable substance is, for example, for water to be sprayed directly onto the braking surfaces 13, 19 by means of controlled spray nozzles, as indicated by an arrow 45 in FIGS. 4 and 6.

FIG. 7 shows another embodiment in which a fiber-reinforced plastics spring 67 bears on a wedge 66 and a metal brake shoe 69 is guided in a side mounting 68 of the top mounting 2. In this embodiment, an interior 40 of the brake shoe 69 can be ventilated for cooling. However, it is even more effective to use a liquid coolant which flows through ducts 71 in the top brake shoe 69 and through ducts 72 in a bottom brake shoe 70 borne via elastomeric pad 73 on the bottom mounting 3. Advantageously, substantially the same cooling performances are provided at the top and at the bottom since the braking energies at the top and at the bottom are substantially the same and, as previously mentioned, a uniform and not too high temperature distribution is the aim. Differences in the construction of the top and bottom brake shoes due to considerations of operation can be compensated for by appropriate metering of the coolant and dimensioning of the conveying means or conveying ducts. Also, a rotation of the projectile after each pick helps to even out temperatures.

FIG. 8 shows another example of a liquid-cooled loom brake having cooling pipes 76 which are in heat-conductive contact with a lightweight metal brake shoe 74. Springing is provided by a carbon-fiber-reinforced plastics spring 77 retained and guided by side plates 78.

In addition to the examples described, other kinds of cooling, such as thermoelectric effects, can be used in accordance with the teachings disclosed.

The invention thus provides a simple arrangement for dissipating heat in a projectile-catching brake permitting use of the brake for high speed picking of plastic or metal projectiles.

What is claimed is:

1. In combination, a projectile-catching brake having a pair of brake shoes defining braking surfaces for catching a projectile therebetween; and cooling means for directing a continuous flow of coolant at least into the vicinity of said braking surfaces.

2. The combination as set forth in claim 1 wherein at least one brake shoe has at least one duct extending therethrough in communication with said cooling means to convey the coolant therethrough.

3. The combination as set forth in claim 1 which further comprises at least one tube in heat-conductive contact with at least one brake shoe and in communication with said cooling means to convey the coolant therethrough.

4. The combination as set forth in claim 1 wherein the coolant is a liquid coolant.

5. The combination as set forth in claim 1 wherein said cooling means includes a closed circuit for conveying coolant to and from said braking surfaces, said circuit having a heat exchanger to remove absorbed heat of braking from the coolant.

6. The combination as set forth in claim 1 wherein the coolant is air.

7. The combination as set forth in claim 6 wherein said cooling means includes a plurality of nozzles for directing air at elevated pressure to said brake shoes.

8. In combination, a projectile-catching brake having a pair of brake shoes defining braking surfaces for catching a projectile therebetween; and cooling means for directing a flow of coolant at least into the velocity of said braking surface, said cooling means including a heat pipe having one and extending along a braking surfaces as a cooler and an opposite end disposed as a heat exchanger.

9. In combination, a projectile-catching brake having a pair of brake shoes defining braking surfaces for catching a projectile therebetween; and cooling means for directing a flow of coolant at least into the velocity of said braking surfaces, said cooling brake shoes defining braking surfaces means being an open a evaporation cooler having capillary evaporation surfaces.

10. In combination a projectile-catching brake having a pair of brake shoes defining braking surfaces for catching a projectile therebetween, at least one brake shoe being a hollow body member; and cooling means for directing a flow of coolant at least into the vicinity of said braking surfaces.

11. The combination as set forth in claim 10 wherein said member is made of metal.

12. In combination a plastic projectile;

a projectile-catching brake having a pair of brake shoes defining braking surfaces for catching said projectile therebetween; and cooling means for directing a continuous flow of coolant into the vicinity of said braking surfaces for dissipating heat therefrom caused by braking of said projectile.

13. The combination as set forth in claim 12 which further comprises at least one tube in heat-conductive contact with at least one brake shoe and in communication with said cooling means to convey the coolant therethrough.

14. In combination a plastic projectile;

a projectile-catching brake having a pair of brake shoes defining braking surfaces for catching said projectile therebetween, a mounting for each brake shoe and a resilient pad between each brake shoe and a respective mounting, each pad having at least one duct to convey a coolant therethrough; and cooling means for directing flow of coolant through said duct in each said pad for dissipating heat from said braking surfaces caused by braking of said projectile.

15. In combination a plastic projectile;

a projectile-catching brake having a pair of brake shoes defining braking surfaces for catching said projectile therebetween, each brkae shoe including a metal body; and an open evaporation cooler having a capillary evaporation surface on said brake shoe body for receiving a flow of liquid coolant and evaporating liquid coolant therefrom to dissipate heat from said brake shoe body caused by braking of said projectile.

* * * * *

UNITED STATES PATENT AND TRADEMARK OFFICE
CERTIFICATE OF CORRECTION

PATENT NO. : 4,872,487

DATED : October 10, 1989

INVENTOR(S) : PETER RIESEN

It is certified that error appears in the above-identified patent and that said Letters Patent is hereby corrected as shown below:

Column 1, line 25, "projectiles" should be -projectiles.-
Column 2, line 61 "issed" should be -issued-
Column 3, line 33 "bottom top" should be -bottom and top- Column 5, line 26 "maximum-temperature temperature" should be -maximum-temperature"
Column 5, line 46 "ad" should be -and-
Column 7, line 21 "one and" should be -one end-
Column 7, line 22 "surfaces" should be -surface-
Column 7, line 30 "velocity" should be -vicinity- Column 7, line 32 "open a" should be -open-

Signed and Sealed this

Twelfth Day of February, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,872,487

DATED : October 10, 1989

INVENTOR(S) : PETER RIESEN

It is certified that error appears in the above-identified patent and that said Letters Patent is hereby corrected as shown below:

Column 7, line 20 change "velocity" to -vicinity-
Column 7, line 30 cancel "brake shoes defining braking surfaces"

Signed and Sealed this

Twenty-eighth Day of April, 1992

*Attest:*

HARRY F. MANBECK, JR.

*Attesting Officer*

*Commissioner of Patents and Trademarks*